United States Patent [19]

Tajima et al.

[11] Patent Number: 5,030,996

[45] Date of Patent: Jul. 9, 1991

[54] IMAGE FORMING APPARATUS WITH AC BIAS VOLTAGES FOR PREVENTING DEVELOPER MIXTURE

[75] Inventors: Hatsuo Tajima, Matsudo; Yoshiaki Kobayashi, Tokyo, both of Japan

[73] Assignee: Canon Kabushiki Kaisha, Tokyo, Japan

[21] Appl. No.: 574,893

[22] Filed: Aug. 30, 1990

[30] Foreign Application Priority Data

Aug. 31, 1989 [JP] Japan ..... 1-223196

[51] Int. Cl.[5] ..... G03G 21/00

[52] U.S. Cl. ..... 355/246; 118/645; 355/326

[58] Field of Search ..... 355/246, 214, 326, 327, 355/328, 261, 265, 266; 118/645, 647, 651, 653; 346/157

[56] References Cited

U.S. PATENT DOCUMENTS

| | | | |
|---|---|---|---|
| 3,866,574 | 2/1975 | Hardennrook et al. | 355/259 |
| 3,890,929 | 6/1975 | Walkup | 355/259 X |
| 3,893,418 | 7/1975 | Liebman et al. | 355/259 X |
| 4,292,387 | 9/1981 | Kanbe et al. | 355/276 X |
| 4,395,476 | 7/1983 | Kanbe et al. | 355/265 X |
| 4,416,533 | 11/1983 | Tokunaga et al. | 355/326 |
| 4,572,651 | 2/1986 | Komatsu et al. | 355/244 |
| 4,600,295 | 7/1986 | Suzuki | 118/647 X |
| 4,610,531 | 9/1986 | Hayashi et al. | 355/246 |
| 4,653,427 | 3/1987 | Hosaka et al. | 118/658 |
| 4,679,929 | 7/1987 | Haneda et al. | 355/265 |
| 4,827,869 | 5/1989 | Takagi | 118/645 |
| 4,887,102 | 12/1989 | Yoshikawa et al. | 355/246 X |

FOREIGN PATENT DOCUMENTS

| | | |
|---|---|---|
| 56-12650 | 2/1981 | Japan . |
| 56-144452 | 11/1981 | Japan . |

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus includes an image bearing member movable through first and second developing positions in the order named and a bias voltage applying device applies a first developing bias voltage to a first developer carrying member and a second developing bias voltage to a second developer carrying member. The first bias voltage has a phase of a first electric field for applying to the toner a force from the developer carrying member to the image bearing member for a period t11 in the first developing position and a phase of a second electric field in the opposite direction to the first for a period t21 in the first developing position. The second bias voltage has a phase of a third electric field for applying to the toner a force from the developer carrying member to the image bearing member for a period t12 in the second developing position and a phase of a fourth electric field in the opposite direction to the third for a period t22 in the second developing zone. A ratio of period t22 to period t12 is larger than a ratio of period t21 to period t11. A; and peak level of the second bias voltage in period t12 is larger than a peak level of the first bias voltage in period t11 and a peak level of the second bias voltage in period t22 is smaller than a peak level of the first voltage in period t21.

13 Claims, 5 Drawing Sheets

IMAGE FORMING APPARATUS WITH AC BIAS VOLTAGES FOR PREVENTING DEVELOPER MIXTURE

FIELD OF THE INVENTION AND RELATED ART

The present invention relates to an image forming apparatus for forming on an image bearing member a plurality of different color toner images.

In such an image forming apparatus, on a surface of the image bearing member having a first toner image formed by a first developing device, a second developing device acts to form a second toner image. In this case, it is desired that the second developing device does not disturb the first toner image and that the toner of the first toner image is not mixed into the second developing device.

U.S. Pat. Nos. 4,572,651 and 4,416,533 discloses that a developing bias voltage source means supplies to each of two developing devices a developing bias voltage having only a DC voltage component, by which the developing operation is effected with the two different color developers accommodated in two developing devices, respectively.

Japanese Laid-Open Patent Application No. 12650/1981 discloses that a developing bias voltage having only a DC voltage component is applied to a downstream developing device with respect to a rotational direction of the photosensitive drum, and the developing operation is effected without contact between the developer and the outer peripheral surface of the photosensitive drum.

In these systems, the mixture of the developer in the developing devices is effectively prevented, but the reproducibility of a line image and a tone image, and the uniformity of a solid image are relatively poor. Particularly in the case of forming overlaid images, the problems are conspicuous. The reason for this is that when the developer transfers from the developing sleeve to the photosensitive drum, there exists such a threshold electric field level that the latent image on the photosensitive drum is not developed if the electric field is less than the threshold, with the result that the image quality is deteriorated. The developing electric field is determined by a potential difference between the potential of the latent image on the photosensitive drum and a DC voltage applied to the developing sleeve, and therefore, it is required that the development clearance between the photosensitive drum and the developing sleeve is so reduced that the developer transfers by the electric field formed therebetween. In addition, high mechanism accuracies are required to provide the proper development clearance. The necessity for increasing the latent image potential requires use of a photosensitive drum having a high charging property.

U.S. Pat. Nos. 3,866,574, 3,890,929, 3,893,418, 4,395,476, 4,292,387 and others have proposed that in place of the DC voltage, an AC voltage is applied to the developer carrying member (sleeve).

By the use of the AC voltage, the above-described problems can be partly solved. However, when plural toner images are formed by the development on the photosensitive drum, the AC voltage provides force to the toner in the direction away from the photosensitive drum and toward the developer carrying member, and therefore, the developer particles are inclined to be mixed in the developing devices.

Japanese Laid-Open Patent Application No. 144452/1981, for example, discloses that an AC developing bias voltage is applied to a downstream developing device with respect to the rotational direction of the photosensitive drum, and the development is effected without contact of the developer to the outer periphery of the photosensitive drum.

U.S. Pat. No. 4,887,102 deals with the strength of a developing electric field formed by an AC voltage applied to the second developing device. U.S. Pat. No. 4,679,929 proposes that the amplitude of an AC voltage applied to the second developing device is made smaller than that in the first developing device. However, with the above-mentioned structures, it is difficult to reconcile the requirements for fog prevention and high density image with the requirement for prevention of the developer mixture. U.S. Pat. No. 4,679,929, discloses that the frequency of the AC voltage applied to the second developing device is higher than that of the first developing device. With this system, however, it is difficult to reconcile the requirement for the good tone gradation and the requirement for the prevention of the developer mixture.

SUMMARY OF THE INVENTION

Accordingly, it is a principal object of the present invention to provide an image forming apparatus wherein the mixture of different color developers in a developing device can be prevented.

It is another object of the present invention to provide an image forming apparatus wherein the color mixture can be prevented, and the image quality is good.

It is a further object of the present invention to provide an image forming apparatus wherein an AC bias voltage is applied to each of plural developing devices, and wherein the mixture of the developers can be prevented, and a good image can be formed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
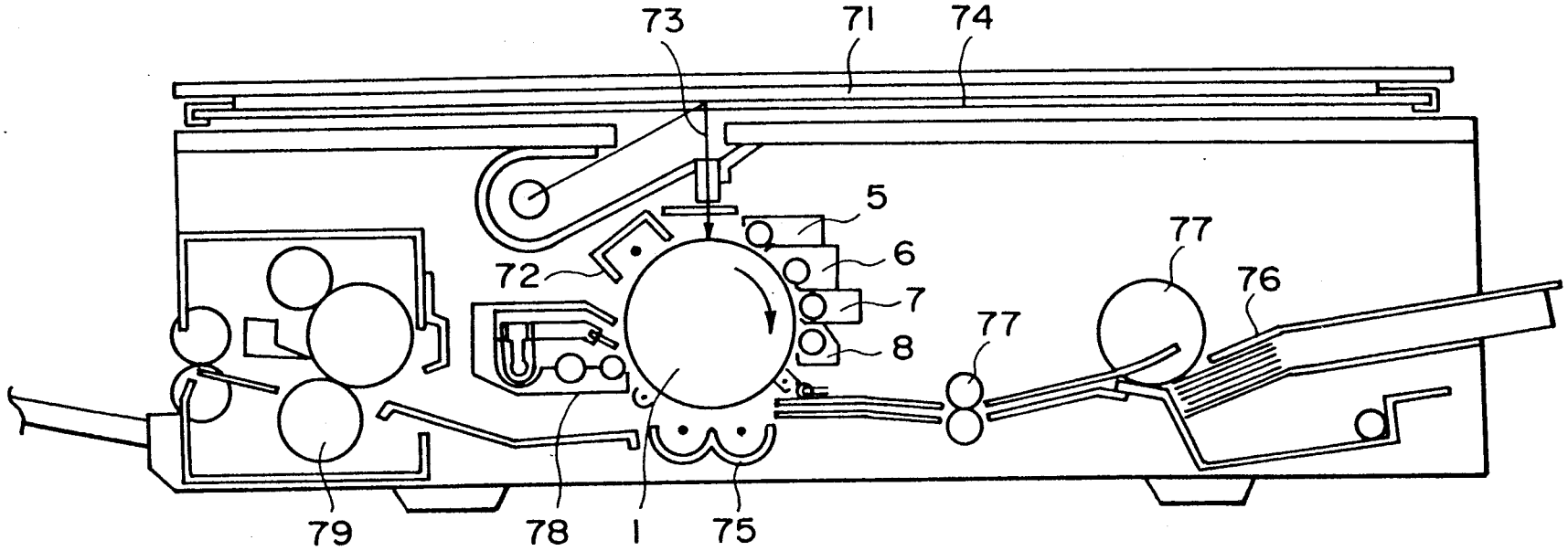
FIG. 1 is a sectional view of an image forming apparatus according to an embodiment of the present invention.

Referring to FIG. 1, there is shown an image forming apparatus according to an embodiment of the present invention, which comprises an image bearing member in the form of an electrophotographic photosensitive drum 1. The photosensitive drum 1 rotates in a direction indicated by an arrow. Above the photosensitive drum 1, there is a corona discharger 72 for uniformly charging the surface of the photosensitive drum 1. The surface of the drum charged by the corona discharger 72 is exposed to image light from an original 71 to be copied carried on an original supporting platen 74 at a position downstream of the corona discharger 72 with respect to the rotational direction of the photosensitive drum 1, so that an electrostatic latent image is formed. The latent image formed on the photosensitive drum 1 is developed by one or more of four developing devices 5, 6, 7 and 8 which are disposed sequentially opposed to the photosensitive drum, downstream of the position of the image exposure with respect to the above direction.

The toner image provided by the developing device is transferred onto a transfer sheet 76 by an image transfer charger 75. The transfer sheet 76 is fed by a roller 77 to an image transfer station, and after the image transfer, the transfer sheet is discharged to the outside of the image forming apparatus through an image fixing device 79 where the toner image is fixed on the transfer sheet. The different color toner images sequentially formed on the surface of the photosensitive drum by the plural developing devices are simultaneously transferred onto the transfer sheet.

In other words, it is not the case that a first color toner image is transferred onto the transfer sheet and then, the transfer sheet is returned to the image transfer station to receive the second color toner image, but it is the case that the different color toner images are transferred at once onto the transfer sheet by one passage of the transfer sheet through the transfer station.

Figure 2:
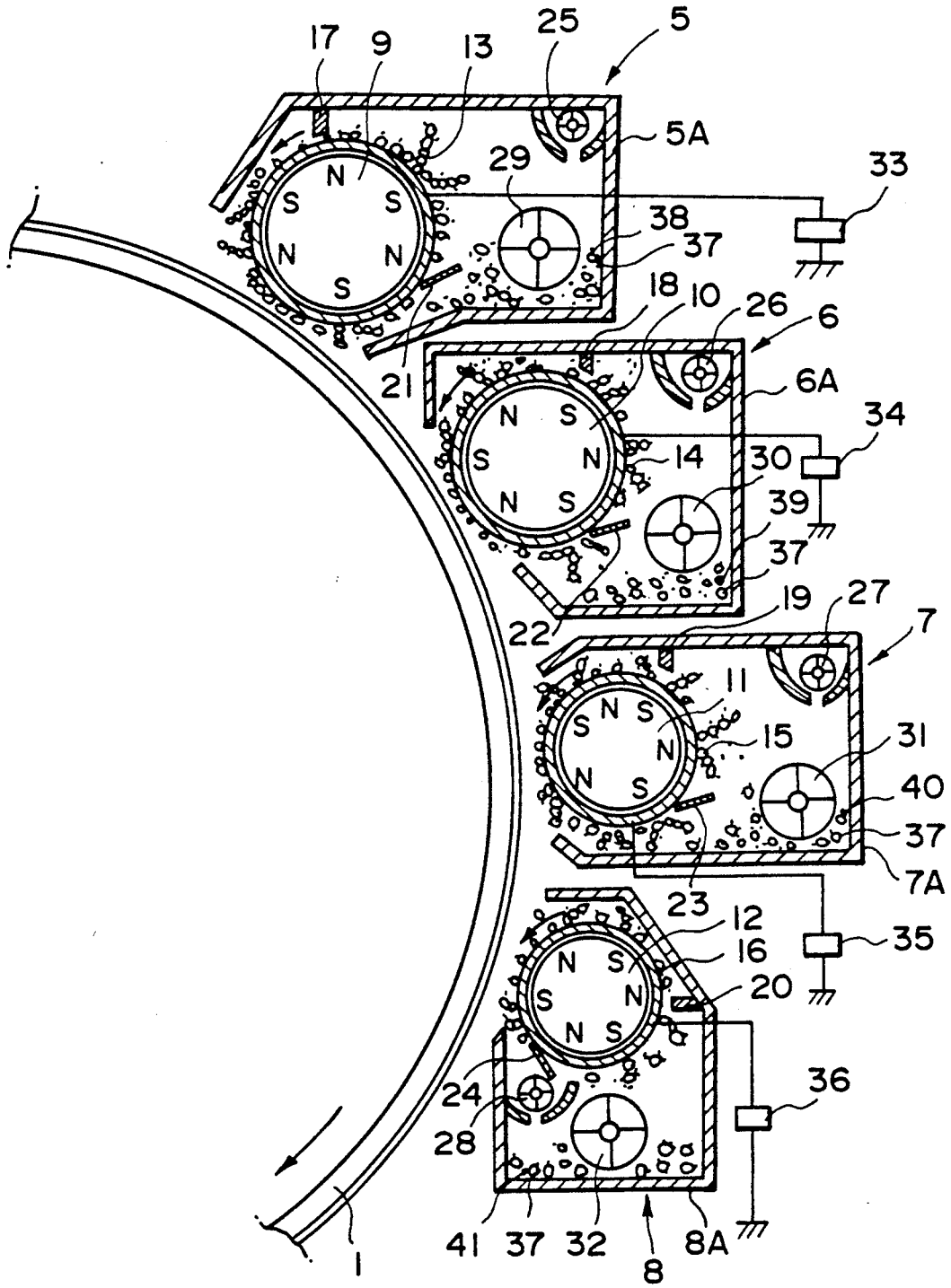
FIG. 2 is an enlarged sectional view of a major part of the forming apparatus of FIG. 1.

Referring to FIG. 2, the developing devices 5, 6, 7 and 8 will be described in detail. Each of the developing devices 5, 6, 7 and 8 includes a non-magnetic developing sleeve 13, 14, 15 or 16 (developer carrying member), which contains therein a stationary magnet 9, 10, 11 or 12 (magnetic field generating means). Each of the developing sleeves is disposed in the associated one of the developer containers 5A, 6A, 7A and 8A and is exposed to the surface of the photosensitive drum 1 at each of the developing positions. The developing sleeves rotate in the counterclockwise direction to carry the developer to the developing position or zone.

In contact to or adjacent to an outer periphery of each of the developing sleeves, there are regulating blades 17, 18, 19 or 20 (developer carrying plate) for regulating an amount of the developer (thickness of a layer of the developer) carried on the developing sleeve to the developing zone, and a scraping blade 21, 22, 23 or 24 for scraping the developer off the developing sleeve.

Each of the developer containers contain a two component developer containing non-magnetic toner particles and magnetic carrier particles 37 mixed therewith. The colors of the toner 38 in the developing device 5, the toner 39 in the developing device 6, the toner 40 and the developing device 7 and the toner 41 in the developing device 8 are, yellow, magenta, cyan and black, respectively. Each of the containers is provided with a toner supply screw 25, 26, 27 or 28 effective to supply the toner, and a stirring plate 29, 30, 31 or 32 for stirring the developer.

The magnetic carrier particles 37 have an average particle size of 30–100 microns, preferably 40–80 microns, and the volume resistance of the carrier particles is not less than $10^7$ ohm.cm and not more than $10^{12}$ ohm.cm, preferably not less than $10^8$ ohm.cm and not more than $10^{10}$. The magnetic carrier particles may be made of ferrite particles (maximum magnetization of 60 emu/g) coated with a very thin resin layer.

The volume resistivity of the magnetic particles is determined using a sandwiching type cell. The magnetic particles are sandwiched in a clearance between electrodes having measuring electrode area of 4 $cm^2$, the weight of 1 kg is applied on one of the electrodes, and a voltage E is applied between the electrodes. The resistance of the magnetic particles is determined from the electric current flowing through the electric circuit.

The developing sleeves 13, 14, 15 and 16 are electrically coupled with the bias voltage sources 33, 34, 35 and 36. Each of the bias sources includes an AC source (peak-to-peak voltage of 100 V–3 KV and the frequency of 100 Hz–5 KHz, for example) and a DC voltage source (not more than 1 KV, for example), by which a DC biased AC voltage is applied to each of the sleeves. The biased AC voltage may be in the form of a vibratory voltage vibrating across the 0 V level, in the form of a vibratory voltage vibrating only in a positive side or only in a negative side or the like, and the waveform thereof may be a sine wave, a rectangular wave, a triangular wave or the like. By doing so, an alternating voltage having a direction alternately reversing is formed in the developing zone. A small gap is formed between the developing sleeve and the photosensitive drum, the minimum gap therebetween being not more than 1 mm, for example.

The thickness of the developer layer on each of the developing sleeves in the associated developing zone is smaller than the gap between the sleeve and the photosensitive drum in the associated developing zone. The regulating blades 17, 18, 19 and 20 regulate the developer layers on the respective sleeves to satisfy this. Therefore, each of the developing devices is a socalled non-contact type, in this embodiment. It is preferable that the downstream developing devices 6, 7 and 8 are of the non-contact type so as not to scrape the toner images provided by the upstream developing device or devices. The most upstream developing device, that is, the developing device 5 for forming the first toner image may be of a contact type in which the layer of the developer is contacted to the drum to develop the latent image. However, the developing device 5 is also of the non-contact type, where a good quality of the image is desired without trace of brushing by the magnetic brush and/or where the drum is rotated plural turns while carrying the toner image or images wherein a different developing device is operated for each of the rotations to form superposed plural color toner images For this reason, the following description will be made as to the case wherein the developing device 5 is also of the non-contact type.

In this embodiment, as shown in FIG. 1, photosensitive drum 1 is uniformly charged by the corona discharger 72, and thereafter is exposed to image light 73 by the light reflected by the original. Then, one or more of selected ones of the developing devices 5–8 are operated. For example, the developing devices 5 and 6 are operated. In this case, the developing device 5 is operated to develop the electrostatic latent image on the photosensitive drum with the yellow toner, and subsequently, the same electrostatic latent image (yellow toner image) is further developed with the magenta toner by the developing device 6, by which the visualized image after being fixed is different from the yellow and from the magenta, more particularly, red, for example. Similarly, an image having any desired color can be provided by properly selecting the developing devices 5-8 and by adjusting the amounts of toner depositions. The black image can be reproduced by the developing device 8 alone.

The toner image thus produced is transferred at once onto the transfer sheet by the transfer charger 75, as will be understood from FIG. 1, and the transferred image is fixed.

Figure 3:
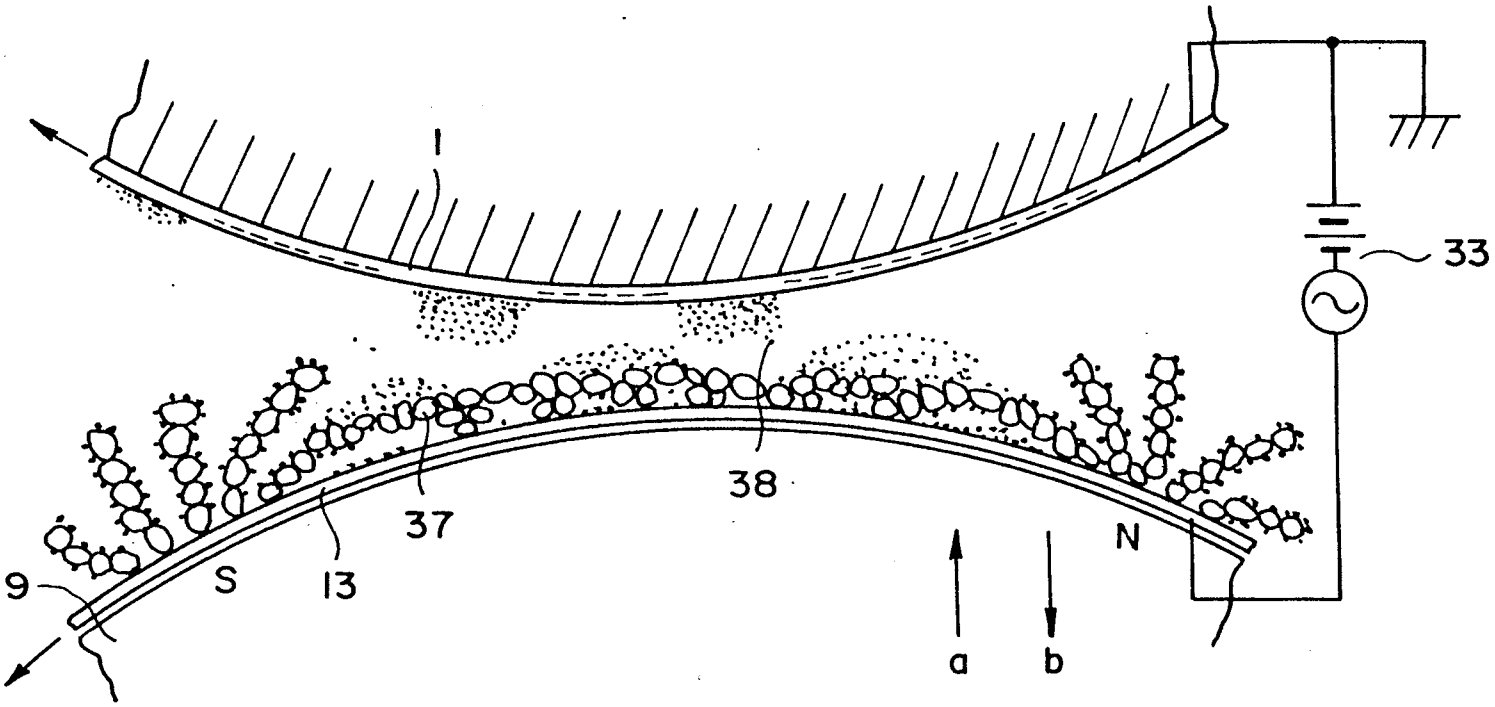
FIG. 3 is a further enlarged sectional view of a developing each of the developing devices.
Figure 4:
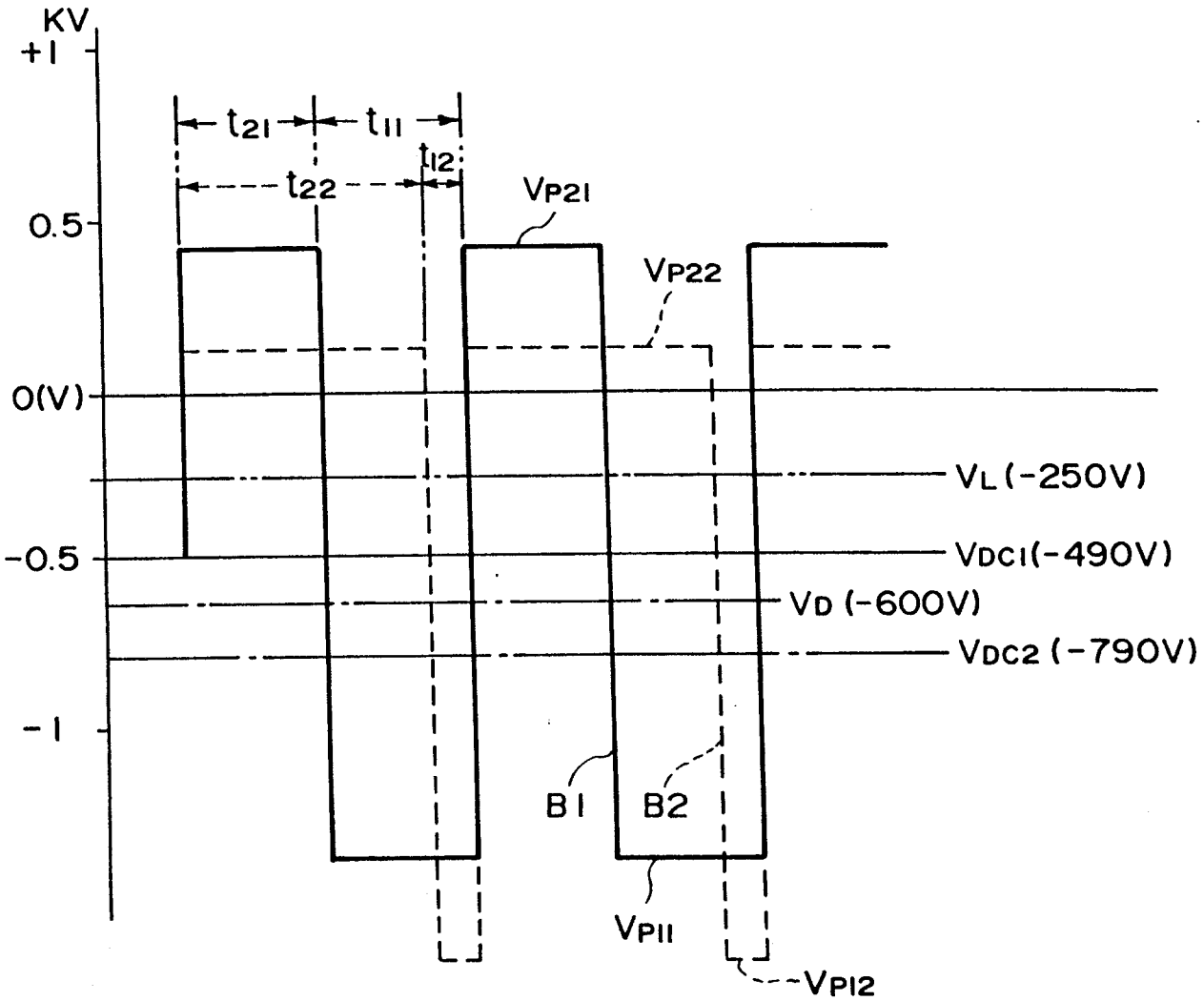
FIG. 4 is a graph illustrating AC bias voltages applied to first and second developer carrying members.

Referring to FIGS. 3 and 4, the behavior in the developing zone will be described in detail. Since the developing devices have the similar structure, only the developing device 5 is taken.

The photosensitive drum 1 carries the electric charge constituting the latent image. In this embodiment, the electric charge constituting the electrostatic latent image is of negative polarity, and the toner is triboelectrically charged to the negative polarity by the friction with the carrier particles, so as to effect the reverse development. In this embodiment, the photosensitive drum 1 and the developing sleeve 13 are rotated in the directions indicated by the respective arrows to provide the same peripheral movements in the developing zone. In the gap therebetween, an alternating electric field is formed by the bias source 33. On the other hand, upstream of the position where the gap between the photosensitive drum 1 and the developing sleeve 13 is minimum, a magnetic pole N having an N magnetic polarity is disposed, and downstream thereof, a magnetic pole S having an S polarity is disposed. The magnetic polarities may be interchanged. In any case, a couple of adjacent magnetic poles having opposite polarities is disposed in this manner, by which a magnetic field having a strong tangential component (tangential to the periphery of the sleeve) is formed in the developing zone. Then, as shown in FIG. 3, the magnetic carrier particles 37 form a chain along the surface of the sleeve. In other words, the chains of the carrier particles are laid down along the surface of the sleeve, and therefore, a very thin layer of the two component developer is formed in the developing zone without contact to the drum (U.S. Pat. No. 4,653,427).

Since, the quantity of the developer conveyed into the developing zone is relatively small, so that the density of the chains of the magnetic carrier particles is not so large. Therefore, the toner particles are supplied to the drum from the surfaces of the magnetic carrier particles and from the surface of the sleeve through the clearances between the chains. Since the development using the alternating electric field has a high developing efficiency, and therefore, a sufficient density toner image can be provided by a thin developer layer.

As will be understood from FIG. 4, in this embodiment, the polarities of the charge constituting the latent image are negative both at the image portion $V_L$ (light potential portion exposed to the light) and at the nonimage portion VD (dark potential portion not exposed to the light) (the absolute value of the nonimage portion potential is larger than the absolute value of the image portion potential). The toner is negatively charged. The direction of the electric field in the developing zone is alternating, and therefore, the direction changes in the clearance between the photosensitive drum and the developing sleeve, as shown by the arrows a and b in FIG. 3, and the change is repeated. In a phase t11 (FIG. 4) in which a negative part of the bias voltage B1 is applied to the developing sleeve 13, the direction of the electric field is b in FIG. 3. On the other hand, at this time, negative electric charge is injected from the developing sleeve into the carrier particles having the above-described electric resistivity. Since the direction of the electric field is b as described above, the carrier particles receive the force in the direction a which is opposite to the direction b, so that the chains are bulged as a whole toward the drum. This bulging promotes the release of the toner particles from the chains and from the surface of the sleeve. Since the toner particles 38 deposited on the surfaces of the developing sleeve 13 and the magnetic particles 37 are charged to the negative polarity, as described above, they receive the force in the direction a by the electric field in the clearance in the direction b so as to be moved to the light potential portions of the photosensitive drum 1.

In the phase t21 (FIG. 4) in which a positive part of the alternating voltage B1 is applied on the developing sleeve 13, the direction of the electric field formed in the developing zone is as indicated by the arrow a, so that it is opposite from the direction b of the electric field. Therefore, the chains receive the force in the direction b by the electric field in the direction a, so that they are collapsed toward the developing sleeve to be contacted thereto.

On the other hand, the toner particles 38 on the photosensitive drum 1 are charged to the negative polarity, they receive the force in the direction b by the electric field in the direction a. Thus, in the phase t21, a part of the toner particles on the photosensitive drum 1 transfer back to the developing sleeve 13 or to the magnetic particles 37. The phases t11 and t21 are alternated repeatedly, by which the developer repeats the above motions. The motions stop by the increase of the clearance between the sleeve and the photosensitive drum due to the rotation of the sleeve. Upon the stoppage of the motion, an amount of the toner particles corresponding to the potential of the electrostatic latent image remains on the drum. In this manner, a toner image is formed.

Since the developing operation is performed in the reverse way in this embodiment, the toner is deposited on the light potential portion $V_L$, and the dark potential portion VD constitutes the background area of the image substantially free from the toner deposition. In addition, the second color toner is deposited by the second developing device superposedly on the first color toner image at the light potential region to which the first color toner is deposited by the first developing device. By the deposition of the first color toner, the absolute value of the potential of the light potential portion increases by 10 V-50 V. However, the potential difference from the dark portion potential is still sufficient, and therefore, the second color toner image having the sufficient density can be provided even if the second developing device is operated in the manner described above.

The problem of the color mixture with the conventional apparatus arises from the reverse movement of the toner particles from the drum to the sleeve in the developing operation for the second and subsequent colors. In the present invention, the reverse motion of the toner is suppressed in the second and subsequent developing operation or operations.

In FIG. 4, the broken lines represent the bias voltage B2 applied to the sleeve during the developing operation for the second and subsequent color or colors, in this embodiment of the present invention. In this embodiment, the frequency of the bias voltage B1 and the frequency of the voltage B2 are the same.

When a negative part of the alternating bias voltage B2 is applied in the phase t12 to the sleeve 14 of the second developing device, that is, the developing device 6, for example, the direction of the electric field in the developing zone is as indicated by the arrow b (FIG. 3), and therefore, the toner particles 39 receive the force in the direction a. Similarly to the case described in the foregoing, the toner particles 39 are released from the magnetic carrier particles and the surface of the sleeve to move to the light potential regions of the drum 1. When the negative part of the alternating bias voltage B2 is applied to the sleeve 14 subsequently in the phase t22, the electric field in the developing zone becomes as indicated by the arrow a. Here, it should be noted that the peak level Vp22 of the bias voltage B2 in the phase t22 is lower than the peak level Vp21 in the phase t21 of the bias voltage B1 (the absolute value is meant when the peak level is said high or low). Therefore, the electric field (the electric field for moving the toner from the drum to the sleeve) in the developing zone in the phase t22 is so weak that the toner particles 38 constituting the first toner image or the toner particles 39 having moved to the light potential region of the drum are hardly moved to the sleeve 14. Therefore, the undesirable toner mixture can be prevented.

The voltage in the phase t21 and t22 has the function of preventing the production of the foggy background. Therefore, the fact that the peak voltage level Vp22 in the phase t22 of the second bias voltage B2 is smaller than the peak voltage level Vp21 in the phase t21 in the first bias voltage B1, means that the fog preventing function is weaker by the peak voltage level Vp22 than by the peak voltage level Vp21. However, as shown in FIG. 4, the ratio (t22/t12) of the time period of the phase t22 to the time period of the phase t12 in the second developing bias voltage B2 is larger than a ratio (t21/t11) of the time period of the phase t21 to the period of the phase t11 in the first bias voltage B1. Therefore, although the electric field itself is relatively weaker in the phase t22, the duration of the phase t22 is relatively longer, and therefore, the production of the foggy background by the second developing device can be effectively prevented.

On the other hand, the duration of the phase t12 in which the second developing device moves the toner particles from the sleeve to the drum is relatively shorter, because the duration of the phase t22 is relatively longer. This means that the duration in which the toner is moved to the drum is shortened. This can result in insufficient image density of the resultant image. However, as shown in FIG. 4, the peak voltage level Vp12 is higher during the phase t12 of the second bias than the peak voltage level Vp11 in the phase t11 of the first bias. Therefore, although the duration of the phase t12 is relatively short, the electric field in the duration is relatively strong, so that a sufficient amount of the toner can be deposited to the image portion.

As will be understood from the foregoing descriptions, when three color toners are to be superposed, the relation between an AC bias voltage applied to the third color developing device, for example, the sleeve 15 of the developing device 7 and an AC bias voltage B2 applied to the sleeve 14 of the second developing device is selected so as to be similar to the relation between the alternating bias voltages B2 and B1.

Assuming that t13 and t14 are b direction electric field phases of an alternating bias voltage B3 applied to the sleeve 15 and of an AC bias voltage B4 applied to the sleeve 16, respectively, and t23 and t24 are a direction electric field phases of them, respectively; Vp13 and Vp23 are peak levels in the phases t13 and t23 of the AC bias voltage B3; and Vp14 and Vp24 are peak levels in the phases t14 and t24 of the AC bias voltage B4.

The time duration ratios in the phases of the respective bias voltages and the peak voltage levels thereof are selected when the development is effected with the four color toners in the apparatus of FIG. 2;

$$(t21/t11)<(t22/t12)<(t23/t13)<(t24/t14)$$

$$Vp11<Vp12<Vp13<Vp14$$

$$Vp21>Vp22>Vp23>Vp24$$

In the above inequations, the voltage peaks are on the basis of the absolute values.

Experiments with the apparatus of FIG. 2 will be described.

EXPERIMENT 1

The peripheral speeds of the developing sleeve and the photosensitive drum were 210 mm/sec and 160 m/sec, respectively.

Each of the developing sleeves was made of stainless steel (SUS 316 (JIS)) having a diameter of 20 mm. The surface thereof was sand-blast-treated with blasting particles #400 having irregular shapes. The magnet was magnetized with six magnetic poles having alternating N and S polarities, as shown in FIG. 2. The gap between the developing sleeve and the regulating blade in each of the developing devices was 350 microns.

The regulating blade was made of non-magnetic stainless steel having a thickness of 1.2 mm. The magnetic carrier particles were made of ferrite (maximum magnetization of 60 emu/g) which are coated with very thin silicone resin layer. The carrier particles had an average particle size of 60–50 microns, and a true density of 5.16 g/cm$^3$.

The used toner was electrically insulative toner particles of non-magnetic property. The toner particles comprised 100 parts of polyester resin material and 5 parts of the pigment, and the toner particles had an average particle size of 8 microns. The pigments were copper phthalocyanine pigment for the cyan color, diazo pigment for the yellow color, and monoazo pigment for the magenta color. The black toner comprised the above pigments at the ratio of 1:2:1. In each of the toners, 0.4 % of colloidal silica was added in order to improve the flowability of the toners.

The developer layer formed on each of the developing sleeve had a thickness of 300 microns in the developing zone. The toner ratio, that is, $(T/(C+T))\times 100$ was approximately 8–12 %, where C was the weight of the magnetic carrier particles, and T was the weight of the toner particles. The electric charge of the toner particles 38 and 39 were approximately $-15\ \mu C/g$.

The developer particles were formed into a magnetic brush erected by the magnetic field at the positions of the magnetic poles in the developing sleeve with the exception of the developing zone. The maximum height of the brush was approximately 0.8–1.3 mm. The magnetic brush has the toner particles. The starting developer was the mixture of 270 g of the magnetic particles and 30 g of the toner particles.

The developing device was incorporated in a color image forming apparatus shown in FIGS. 1 and 2. The minimum gap between the surfaces of the photosensitive drum 1 (organic photoconductor material) and the developing sleeve 13 was 500 microns. The ratio of the peripheral speeds of the photosensitive drum and the developing sleeve was 1:1.3. The amount of the developer M (g/cm$^2$)/unit area of the developing sleeve was 35 mg/cm$^2$ upon non-erection. The outside diameter of the photosensitive drum was 160 mm. The photosensitive drum had the OPC photosensitive layer. The latent image was constituted by the dark portion potential (non-image portion potential $V_D$ of −600 V and a dark portion potential (image portion potential) $V_L$ of −250 V.

The bias voltage source 33 applied to the developing sleeve 13 of the developing device 5 was a rectangular alternating voltage having a frequency f of 2000 Hz and a peak-to-peak voltage Vpp of 1800 V biased by a DC voltage of −490 V, in which the ratio t21/t11 was 1.

To the developing sleeve 14 of the developing device 6, the bias voltage source 34 applied a rectangular AC voltage having the same frequency and the same peak-to-peak voltage as with the developing sleeve 13 biased with a DC voltage of −790 V, was applied. The ratio t22/t12 was 4. A latent image was sequentially developed by the developing devices 5 and 6. As a result, uniform clear red image was produced. When the copying operations were continuously carried out for a long period, the toner 38 of the developing device 5 was not mixed into the developing device 6, so that the clear images were maintained.

EXPERIMENT 2

To the structure having the two developing devices 5 and 6 in the Experiment 1, a third developing device 7 was added, so as to produce a three color superposed image.

To the developing sleeve 13 of the developing device 5, the same alternating voltage as with the Experiment 1 was applied. To the developing sleeve 14 of the developing device 6 was applied a rectangular alternating voltage having the same frequency f and the same peak-to-peak voltage Vpp as with the developing sleeve 13 biased with a DC voltage of −690 V. The voltage was supplied by the bias voltage source 34, and the ratio t22/t12 was 3.

To the developing sleeve 15 of the developing device 7, the bias voltage source 35 applied a rectangular alternating voltage having the same frequency f and the same peak-to-peak voltage Vpp as with the developing sleeve 15 of the developing device 7 biased with a DC voltage of −840 V. The ratio t23/t13 was 5.

As a result, uniform and clear images were provided as in the Experiment 1. The toners 38 and 39 were hardly mixed into the developing devices 6 and 7.

From various experiments and investigations, it has been found that it is preferable that the ratio t2/t1 of the alternating voltage is increased with the number of developing operations, that the ratio t22/t12 in the second development is 2–6, and that the ratio t23/t13 in the third development is 3–10, since then the mixture is effectively prevented, and good images can be provided. In addition to the above-described structure, it is further preferable that the amount of triboelectric charge of the toner is sequentially changed in the developing devices since a better image can then be provided, and the contamination of the toner with different color toner can be prevented. The amount of charge of the toner can be controlled by reducing the toner content slightly.

For example, in the foregoing experiments, $(T/(C+T))\times 100$ was 8 %; in the developing device 6, it was 10 %; and in the developing device 7, it was 12 %. Then, the amount of triboelectric charge of the toners 38, 39 and 40 was −23, −18 and −15 μC/g.

The contamination of the toner of the developing devices 6 and 7 with different color toner was prevented. The reasons are considered as follows. Since the amount of triboelectric charge is larger in the absolute value in the upstream developing device, the toner transferred from the developing sleeve to the photosensitive drum is electrostatically deposited on the photosensitive drum with stronger force in the upstream developing device, and therefor, the toner deposited on the drum in the upstream developing process is not easily transferred back to the sleeve by the alternating electric field in the downstream developing process. The first toner 38 and the second toner 39 are electrostatically attracted to the carrier particles and the sleeves 13 and 14 with stronger forces than in the Experiment 2. Therefore, in order to apply strong forces to the toner particles in the phases t11 and t12, it is preferable that the DC component of the bias voltage applied to the sleeves 13 and 14 is higher by 10–50 V in the absolute value than the case of Experiment 2. For example, the DC voltage component of the AC bias voltage applied to the sleeve 13 was −520 V, and the DC voltage component of the AC bias voltage applied to the sleeve 14 was −710 V, and then, good results were obtained.

The developing device not used for the development may be away from the photosensitive drum, and/or supplied with such an electric bias as to prevent the transfer of the toner to the sleeve, by which the unnecessary toner is prevented from being deposited on the photosensitive drum.

The developer may be a one component developer.

The image formation process is not limited to the above-described mono-color process, but the following is usable. After the first developed image formation (the development by the developing device 5 in this embodiment) is completed, the second image is formed without effecting image transfer and cleaning operations. More particularly, the drum 1 having the first toner image is subjected to the uniform charging operation by the corona discharger 72, and the second image exposure and the second developing operation (by the developing device 6 in this embodiment) are effected. Similarly, the third and fourth charging, exposure and developing processes are performed. Thereafter, the image made of the four color toner is transferred onto the transfer sheet at once. In such a process, a multi-color image can be produced, using color separation means and masking means in each of the image exposure operations.

Figure 5:
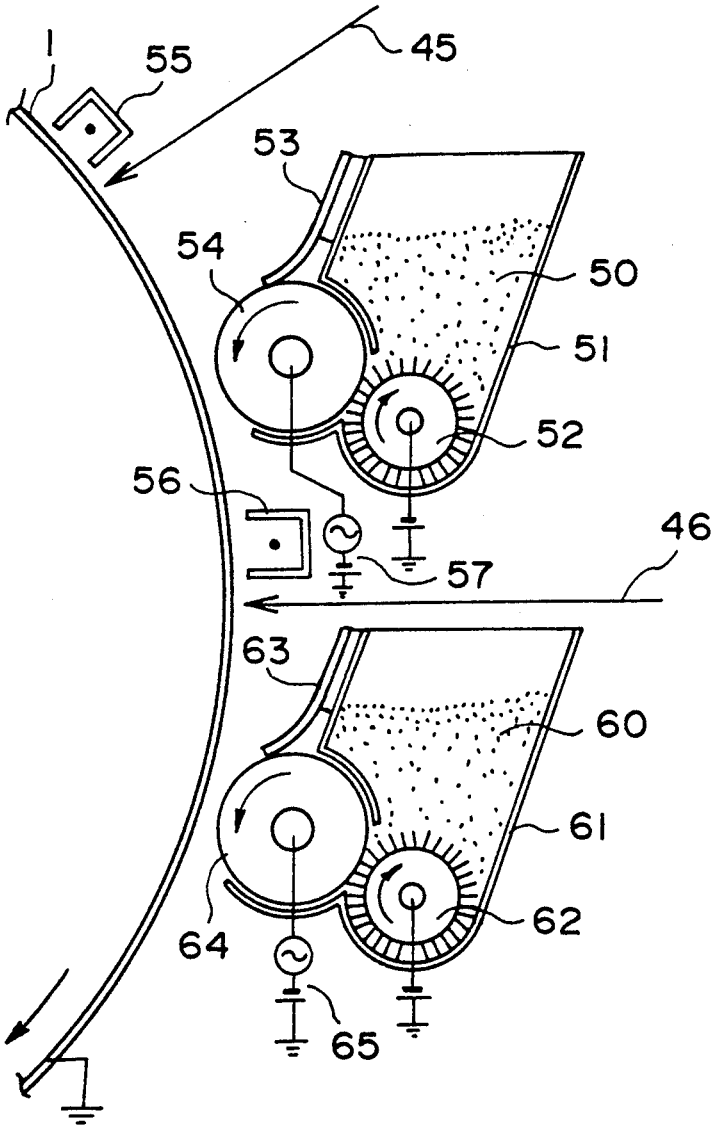
FIG. 5 is a sectional view of a major part of an image forming apparatus according to another embodiment of the present invention.

Referring to FIG. 5, a further embodiment of the present invention will be described, wherein the same reference numerals as in FIGS. 1 and 2 are assigned to the elements having the corresponding functions. In this embodiment, between adjacent developing devices, there are disposed re-charging means and image exposure means, so that subsequent to the development of the first image, the re-charging operation, the second image exposure operation and the second developing operation are performed.

The first and second exposure beams 45 and 46 are produced by a laser optical system in accordance with drive instruction signals produced by an image signal controller (not shown), corresponding to the first and second image signals, respectively. The laser beams are scanningly projected on the surface of the photosensitive drum 1. In this process, the photosensitive drum 1 is uniformly charged by the primary charger 55 and is exposed to the first exposure beam 45, so that a first latent image is formed. Then, the image is developed by the developing device 51 containing one component non-magnetic developer (black toner 50) disposed in the neighborhood of the photosensitive drum 1. Then, the surface of the photosensitive drum carrying the first toner image is electrically charged by the second charger 56, and then is exposed to the second exposure beam, so that a second latent image is formed, and the latent image is developed by the developing device 61 containing the one component non-magnetic developer (red toner) 60 disposed close to the photosensitive drum 1. In this manner, the charging, image exposure and developing steps are effected sequentially, so that plural color toner images are formed on the photosensitive drum, and the toner image is transferred at once onto the transfer material.

The black toner 50 and the red toner 60 in the developing devices 51 and 61 are supplied to the developing rollers 54 and 64 by fur brushes 52 and 62. The fur brushes 52 and 62 not only stir the toner in the developing devices 51 and 61 but also scrape the developing roller carrying the toner remaining after the development to prevent the production of ghost image.

The rollers 54 and 64 rotate in the direction indicated by the arrows to carry the developer to the respective developing zones. The layer thickness of the developer conveyed to the developing zone is regulated by the associated regulating blade 53 or 63. The blades 53 and 63 are in the form of elastic blades made of rubber or metal leaf springs or the like. They are lightly contacted to the associated rollers 54 and 64 to regulate the layer thickness of the developer conveyed to the developing zone to be smaller than the clearance between the drum 1 and the rollers 54 and 64. The blades 53 and 63 are effective to triboelectrically charge the developer by the rubbing with the developing rollers 54 and 64, respectively.

The developing rollers 54 and 64 are electrically coupled with developing bias sources 57 and 65, respectively to form alternating electric fields between the photosensitive drum 1 and the developing rollers 54 and 64.

The clearance between the photosensitive drum 1 and the developing roller 54 or 64 is approximately 300 microns, and the toner layer thickness on the developing roller 54 or 64 is approximately 40 microns. The black toner 50 was charged to $-20\ \mu C/g$, and the red toner 60 was charged to $-50\ \mu C/g$, triboelectrically.

The dark portion potential (non-image portion potential) $V_D$ of the first latent image was $-600$ V, and the light portion potential (image portion potential) $V_L$ was $-250$ V. The voltage source 57 applied to the developing roller 54 was a rectangular alternating voltage having a frequency of 1800 Hz and a peak-to-peak voltage Vpp of 1400 V with the ratio t21/t11 equal to 1 and biased with a DC voltage of $-500$ V.

The dark portion potential of the second latent image was $-650$ V, and the light portion potential was $-280$ V. The bias voltage source 65 applied to the developing roller 64 was a rectangular alternating voltage having the same frequency and the same peak-to-peak voltage as with the developing roller 54 with the ratio t22/t12 equal to 4 and biased with a DC voltage of $-800$ V.

In this embodiment, the resultant images were good and uniform as in the foregoing embodiment. In addition, the developing device 61 is not contaminated with the black toner 50.

In the foregoing embodiments, the first developing device transfers the toner particles by an alternating electric field from the developer carrying member to the image bearing member, and is transferred back from the image bearing member to the developer carrying member. However, this is not limiting. For example, by properly selecting the peak voltage level in the phase t21, the toner once transferred to the image bearing member may be prevented from being transferred back to the developer carrying member also in the first developing device. However, in any case, and in any alternating bias voltage, the light portion potential and the dark portion potential of the latent image is between the peak voltage level (first peak level) of the voltage providing the electric field in the direction a and the peak voltage level (second peak level) of the voltage providing the electric field in the direction b. In other words, the absolute value of the difference between the light portion potential and the dark portion potential is smaller than the absolute value of the difference between the first peak level and the second peak level of the bias voltage, that is, the peak-to-peak voltage Vpp.

In the foregoing embodiments, the peak-to-peak voltages Vpp of the bias voltages are the same. However, the peak-to-peak voltage Vpp of the alternating bias voltage applied to the downstream developing device with respect to the rotational direction of the photosensitive drum may be smaller than the peak-to-peak voltage Vpp of the alternating bias voltage applied to the upstream developing device.

In the foregoing embodiments, the reverse development is taken wherein such portions of the surface of the photosensitive drum which are exposed to light (light potential portion) receive the toner. However, the present invention is applicable to the case of regular development wherein the toner is deposited to the non-exposure portion (dark potential portions). In the case of the regular development, the toner is triboelectrically charged to the polarity opposite to that of the latent image.

In the foregoing embodiments, the negative polarity electrostatic latent image is developed, but the present invention is applicable to an image forming apparatus wherein a positive polarity electrostatic latent image is formed and is reverse-developed or regular-developed.

While the invention has been described with reference to the structures disclosed herein, it is not confined to the details set forth and this application is intended to cove such modifications or changes as within the purposes of the improvements or the scope of the following claims.

What is claimed is:

1. An image forming apparatus, comprising:

an image bearing member movable through first a first developing position and second a second developing position;

first developing means for forming a first toner image on said image bearing member, said first developing means including a first developer carrying member for carrying a first developer comprising first color toner to the first developing position;

second developing means for forming a second toner image on said image bearing member having the first toner image, said second developing means including a second developer carrying member for carrying a second developer comprising second color toner to the second developing position; and bias voltage applying means for periodically applying a first developing bias voltage to the first developer carrying member and a second developing bias voltage to the second developer carrying member, wherein the first bias voltage has a phase in which a first electric field for applying to the toner a force in a direction from the developer carrying member to said image bearing member is formed for a time period t11 in the first developing position and a phase in which a second electric field in a direction opposite to the first electric field is formed for a time period t21 in the first developing position, and wherein the second bias voltage has a phase in which a third electric field for applying to the toner a force in a direction from the developer carrying member to said image bearing member is formed for a time period t12 in the second developing position and a phase in which a fourth electric field in the opposite direction to the third electric field is formed for a time period t22 in the second developing position, wherein a ratio of the period t22 to the period t12 is larger than a ratio of the period t21 to the period t11, a peak level of the second bias voltage in the period t12 being larger than a peak level of the first bias voltage in the time period t11 and a peak level of the second bias voltage in the period t22 being smaller than a peak level of the first bias voltage in the period t21.

2. An apparatus according to claim 1, wherein the first color toner and the second color toner are charged to the same polarity.

3. An apparatus according to claim 2, wherein the frequencies of the first bias voltage and the second bias voltage are the same.

4. An apparatus according to claim 3, wherein peak-to-peak voltages of the first and second bias voltages are the same.

5. An apparatus according to claim 3, wherein a peak-to-peak voltage of the second bias voltage is smaller than a peak-to-peak voltage of the first bias voltage.

6. An apparatus according to any one of claims 1–5, wherein said second developing means includes means for regulating a thickness of a layer of the second developer to be smaller than a minimum clearance between said image bearing member and the second developer carrying member, at the second developing position.

7. An apparatus according to claim 6, wherein the second developer comprises magnetic carrier particles, said second developing means including a stationary magnet disposed in the second developer carrying member, said stationary magnet having adjacent first and second magnetic poles having different magnetic polarities, wherein the first magnetic pole is disposed upstream of a position where the image bearing member and the second developer carrying member are closest to each other and the second magnetic pole is disposed downstream of the position with respect to a movement direction of said second developer carrying member.

8. An apparatus according to claim 6, wherein a charge amount of the second color toner is smaller than a charge amount of the first color toner.

9. An apparatus according to claim 6, further comprising image transfer means for transferring simultaneously the first toner image and the second toner image to a transfer material.

10. An apparatus according to any one of claims 1–5, wherein said first and said second developing means each include means for regulating a thickness of a layer of the developer to be smaller than a minimum clearance between said image bearing member and the associated developer carrying member, at the respective developing position.

11. An apparatus according to claim 10, wherein the first and second developers each comprise magnetic carrier particles and said first and second developing means each include a stationary magnet disposed in said developer carrying members, wherein said stationary magnets have adjacent first and second magnetic poles having different magnetic polarities and the first magnetic poles are disposed upstream of a position where the image bearing member and respective developer carrying member are closest to each other and the second magnetic poles are disposed downstream of the position with respect to a movement direction of the respective developer carrying member.

12. An apparatus according to claim 10, wherein a charge amount of the second color toner is smaller than a charge amount of the first color toner.

13. An apparatus according to claim 10, further comprising image transfer means for transferring simultaneously the first toner image and the second toner image to a transfer material.

* * * * *